United States Patent [19]

West et al.

[11] Patent Number: 4,728,414

[45] Date of Patent: Mar. 1, 1988

[54] SOLVENT DEWAXING USING COMBINATION POLY (N-$C_{24}$) ALKYLMETHACRYLATE-POLY ($C_8$–$C_{20}$ALKYL (METH-) ACRYLATE DEWAXING AID

[75] Inventors: Theodore H. West, Sarnia, Canada; David J. Martella, Princeton, N.J.

[73] Assignee: Exxon Research and Engineering Company, Florham Park, N.J.

[21] Appl. No.: 933,126

[22] Filed: Nov. 21, 1986

[51] Int. Cl.[4] ..... C10G 73/04

[52] U.S. Cl. ..... 208/33; 208/31

[58] Field of Search ..... 208/31, 33

[56] References Cited

U.S. PATENT DOCUMENTS

| | | | |
|---|---|---|---|
| 3,458,430 | 7/1969 | Henselman et al. | 208/33 |
| 3,729,296 | 4/1973 | Miller | 44/62 |
| 3,904,385 | 9/1975 | Sweeney | 44/62 |
| 4,191,031 | 3/1980 | Grisham, Jr. | 208/33 |
| 4,406,771 | 9/1983 | Briens et al. | 208/33 |
| 4,451,353 | 5/1984 | Briens et al. | 208/33 |

*Primary Examiner*—Helen M. S. Sneed
*Assistant Examiner*—Glenn Caldarola
*Attorney, Agent, or Firm*—Joseph J. Allocca

[57] ABSTRACT

Solvent dewaxing of waxy hydrocarbon oils is improved by using a poly (n-$C_{24}$) alkyl methacrylate polymer dewaxing aid in combination with lower melting point weight poly ($C_8$–$C_{20}$) alkyl methacrylate polymer dewaxing aids. The solvent dewaxing processes improved using this combination dewaxing aid are the incremental and total predilution solvent type processes employing either surface chilled indirect heat exchanger means or direct chilling using cold solvent.

The solvent dewaxing processes are those employing normally liquid dewaxing solvents, as exemplified by $C_3$–$C_6$ ketones, such as methyl ethyl ketone, methyl isobutyl ketone and mixtures thereof, mixtures of ketones with aromatic such as MEK/toluene, halogenated $C_2$–$C_4$ hydrocarbons such as tetrachloraethane, trichloro ethylene, etc. Autorefrigerative solvent dewaxing processes employing low boiling point, normally gaseous hydrocarbons, such as propane, propylene, butane, butene and mixtures of such solvents, with the aforesaid ketones, e.g., propane/MEK, are also benefited by use of the present dewaxing aid combination.

Use of the combination dewaxing aid results in an improvement in feed filter rate and liquids/solids. ratio in the dewaxing process.

4 Claims, No Drawings

SOLVENT DEWAXING USING COMBINATION POLY (N-$C_{24}$) ALKYLMETHACRYLATE-POLY ($C_8$–$C_{20}$ALKYL (METH-) ACRYLATE DEWAXING AID

DESCRIPTION OF THE INVENTION

Solvent dewaxing processes wherein waxy hydrocarbons oils, preferably waxy petroleum oils such as lube oils, specialty oils such as white oils or turbine or refrigerator oils, are dewaxed by admixture with a dewaxing aid and a dewaxing solvent, involving either incremental dilution or total predilution, yielding a mixture of waxy oil dewaxing aid and solvent and this mixture is chilled in surface chiller exchangers such as scraped or unscraped surface chillers or other indirect heat exchange apparatus means to a temperature sufficient to precipitate at least a portion of the wax therefrom or, alternatively, the waxy oil either with or without predilution (incremental or total) is contacted with cold dewaxing solvent so as to be directly chilled to the dewaxing temperature by means of the cold solvent, are improved by using as the dewaxing aid a combination dewaxing aid consisting of (a) poly ($C_{24}$) alkylmethacrylate polymer and (b) a lower melting point weight poly ($C_8$–$C_{20}$) alkyl (meth) acrylate polymer.

By use of this combination dewaxing aid the dewaxing process is improved insofar as the filter rate is increased and the liquids/solids ratio is improved.

This dewaxing aid combination aids in solvent dewaxing processes wherein a waxy hydrocarbon oil is mixed with a normally liquid dewaxing solvent and a quantity of the recited dewaxing aid combination to form a mixture which is chilled, either directly using cold dewaxing solvent or indirectly in heat exchange apparatus, to form a slurry comprising wax particles and a solution of dewaxed oil and dewaxing solvent. The dewaxing aid components (a) and (b) may be precombined one with the other for addition to the waxy oil to be dewaxed, either as such or diluted in a suitable wax-free oil to improve flow properties. Alternatively, the components may be added separately and simultaneously or separately and sequentially at the same or separate points within the process. Even in this embodiment the individual components (a) and (b) may be employed as such or diluted in a suitable wax-free oil to improve flow properties. The wax particles which are precipitated are subsequently separated from the dewaxed oil by any of a number of typical liquid/solid separation processes exemplified by, but not limited to, filtration, settling, centrifugation, etc.

The use of the combination (a) plus (b) results in increased feed filter rates and liquids/solids ratios as compared to using no aid at all or using either component individually.

The solvent dewaxing processes benefited by the use of the present combination dewaxing aid are those using normally liquid solvent systems, such as $C_3$–$C_6$ ketones, aromatic hydrocarbons, halogenated hydrocarbons and mixtures thereof, as well as autorefrigerative dewaxing processes employing normally gaseous hydrocarbons, such as propane, propylene, butane, butene, etc. and mixtures of said autorefrigeration hydrocarbons with the aforesaid ketones, e.g., propane/MEK.

BACKGROUND OF THE INVENTION

Waxes in wax-containing hydrocarbon oils are removed therefrom by chilling the oil to precipitate out the wax and then separating the solid wax particles from the dewaxed oil by solid/liquid separation procedures, such as filtration, centrifugation, settling, etc. Industrial dewaxing processes include press dewaxing processes wherein the wax-containing oil, in the absence of solvent, is chilled to crystallize out the wax particles, which are then pressed out by a filter. In general, only light hydrocarbon oil fractions are treated by press dewaxing processes due to viscosity limitations. More widely used are solvent dewaxing processes wherein a waxy oil is mixed with a solvent and then chilled to precipitate the wax as tiny particles or crystals, thereby forming a slurry comprising solid wax particles and a solution of dewaxed oil containing dewaxing solvent. The slurry is then fed to a wax separator (e.g., filter, centrifuge, settler) wherein the wax is removed from the dewaxed oil and dewaxing solvent. Solvent dewaxing processes are used for heavier oil fractions, such as lubricating oil fractions and Bright stocks. Typical dewaxing solvents include low boiling point, normally gaseous autorefrigerative hydrocarbons, such as propane, propylene, butane, pentane, etc., ketones such as acetone, methyl ethyl ketone (MEK), methyl isobutyl ketone (MIBK) and mixtures thereof, aromatic hydrocarbons such as benzene, toluene and xylene, as well as mixtures of ketones and aromatic hydrocarbons, such as MEK/toluene and acetone/benzene.

One of the factors tending to limit the capacity of a solvent dewaxing plant is the rate of wax filtration (and separation in general) from the dewaxed oil, which in turn is strongly influenced by the crystal structure of the precipitated wax. Although the crystal structure of the precipitated wax is influenced by various operating conditions in the dewaxing process, for any given feed it is most strongly influenced by the chilling conditions. The size and crystal structure of the precipitated wax, occlusion of oil in the wax crystal and the condition of the oil left in the crystal are extremely varied and depend on the wax composition and precipitation conditions. These conditions also affect the separation (filtration) rate of the dewaxed oil from the wax and the yield of dewaxed oil. In some cases, most notably when the waxy oil is Bright stock, the wax crystals are of an extremely fine size and not all are separated by filtration, but some leave the filter with the dewaxed oil component which creates an objectionable haze in the oil.

One way of improving the filtration rate and minimizing haze formation is to add a dewaxing aid to the wax containing oil during the dewaxing process.

PRESENT INVENTION

Solvent dewaxing processes wherein waxy hydrocarbon oils, particularly petroleum oils, more particularly waxy lube oil, turbine oil, refrigerator oils, or white oil base stocks, are dewaxed by combining said waxy oil with a dewaxing solvent either by incremental dilution or total predilution and chilling the mixture, either directly using cold dewaxing solvent or in indirect heat exchanger means, are improved by using a dewaxing aid comprising a combination of (a) poly ($C_{24}$) alkyl methacrylate polymer and (b) lower weight poly ($C_8$–$C_{20}$) alkylmethacrylate polymers.

These components (a) and (b) are employed in ratios of (a) to (b) ranging from 10:90 to 90:10, preferably 10:90 to 50:50, more preferably 10:90 to 30:70. Dose levels, based on active ingredient, range from 0.01 to 2.0 weight percent, preferably 0.1 to 2.0 weight percent, most preferably 0.1 to 1.0 weight percent active ingredient.

Component (a) is a poly alkylmethacrylate derived from normal $C_{24}$ alcohol, preferably as pure as possible. This poly ($C_{24}$) alkylmethacrylate has a number average molecular weight as determined by gel permeation chromatography, equivalent polystyrene molecular weight, ranging from about 50,000 to about 500,000 $M_n$, preferably 50,000 to 200,000, most preferably 60,000 to 100,000 $M_n$, and a melting point of about 50° C. to 80°, preferably about 50° C. to 70° C., most preferably about 60° C. to 70° C.

Component (b) is similar to component (a) insofar as it is a poly alkyl (meth-) acrylate but differs in carbon sidechains of 8–20 carbons. It also differs in that it is of a somewhat lower number average molecular weight, ranging from 5,000 to 200,000 $M_n$, preferably 10,000 to 100,000 $M_n$, most preferably 5,000 to 50,000 $M_n$, and because of the lower carbon side length it has lower melting points, melting point being on the order of about −30° C. to 50° C., preferably −20° C. to 40° C., most preferably −10° C. to 30° C. It is the melting point of the polymer that determines its solubility (higher melting point implies lower solubility) and the solubility of the polymer determines what particular waxes the polymer will modify in the dewaxing process. The molecular weight of the polymer determines how effective a polymer of a given melting point (il.e., solubility) is in modifying the morphology of the waxes. The poly alkyl (meth-) acrylate possessing mixed alkyl group side chains having from 8 to 20 carbons. Examples of such poly alkyl methacrylates are Acryloid 144 and Acryloid 150, produced by Rohm and Haas Company. Acryloid 150 is generally described as having an average side chain carbon number >50% $C_{14}$ and lower, and a number average molecular weight of about 5,000 to 200,000, preferably 10,000 to 100,000. Acryloid 150 is reported as having side chains of predominantly $C_{10}$–$C_{20}$, (2% $C_{10}$, 30% $C_{12}$, 27% $C_{14}$, 14% $C_{16}$, 16% $C_{18}$, 11% $C_{20}$). Acryloid 144 is generally described as having side chains of carbon number >50% $C_{16}$ and higher and a number average molecular weight of about 5,000 to 200,000, preferably 10,000 to 100,000. Acryloid 144 is reported as having side chains predomiantly $C_{16}$–$C_{18}$ (4% $C_{12}$, 7% $C_{14}$, 39% $C_{16}$, 45% $C_{18}$ and 5% $C_{20}$). A sample of Acryloid 144 was evaluated and found to have a number average molecular weight of about 23,000 and a melting point of about 29° C., while a sample of Acryloid 150 was also evaluated and found to have a number average molecular weight of about 45,000 and a melting point of about −4° C.

A useful and easily reproducible identification of the polymers is made by relying on their melting points. Component A, the C24 alkylmethacrylate, will have a melting point of between 50° C. to 80° C., preferably 50° C. to 70° C., most preferably 60° C. to 70° C. as determined by differential scanning calorimetry, while the commercially available component B, such as Acryloid 150 and Acryloid 144, will have melting points in the −30° C. to 50° C. range, preferably −20° C. to 40° C., most preferably −10° C. to 30° C. as determined by differential scanning calorimetry (DSC).

This dewaxing aid is advantageously employed as separately prepared components (a) and (b). These components may then be mixed together in the previously recited ratios and added at the desired dose level, either as such or dissolved in a suitable waxfree oil, such as mineral oil or other suitable solvent, such as toluene, benzene, propane, methylene chloride and the like, which imparts to the additive improved flow properties, pumpability, etc. Alternatively, the individual components (a) and (b) can be employed separately (either as such or dissolved in a solvent as previously indicated) and introduced to the dewaxing process simultaneously or sequentially at separate points within the process. The aid, regardless of whether both components are pre-mixed one with the other, or employed separately/-simultaneously or separately/ sequentially, with or without dilution, may be either mixed with the waxy oil prior to chilling or introduce during the chilling process, in either indirect chilling means, such as scraped surface chillers, or, alternatively, direct chilling means employing cold solvent. Preferred direct chilling means employing cold solvent injected along a number of stages therein, a number of which stages are highly agitated insuring instantaneous mixing, is the DILCHILL ® (registered service mark of Exxon Research and Engineering Company) process as presented in U.S. Pat. No. 3,773,650, hereby incorporated herein by reference.

The normally liquid dewaxing solvent that is used in the present invention is not particularly critical; thus, any of the well-known, normally liquid dewaxing solvents can be used. For example, ketones having from 3 to 6 carbon atoms, such as acetone, dimethyl ketone, methyl ethyl ketone, methyl propyl ketone and methyl isobutyl ketone and mixtures thereof, aromatic hydrocarbons, such as benzene, xylene or toluene, mixtures of ketones and aromatic hydrocarbons, such as methyl ethyl ketone/toluene or methyl isobutyl ketone/toluene. Also useful are halogenated hydrocarbons, such as methylene chloride. Further, N-alkyl-pyrrolidones, such as N-methyl-pyrrolidone and N-ethyl-pyrrolidone may be used as the dewaxing solvent. Solvents which may be especially preferred for practicing the process of the present invention include aromatic hydrocarbon, such as toluene, $C_5$–$C_6$ ketones, such as MEK, MIBK and mixtures thereof, mixtures of a ketone and an aromatic hydrocarbon, such as MEK/toluene, halogenated hydrocarbons, such as methylene chloride, and mixtures of acetone and methylene chloride.

Other dewaxing solvents which can be employed are the low boiling point, normally gaseous autorefrigerative hydrocarbons, such as $C_2$–$C_5$ alkanes and alkenes, including propane, propylene, butane, pentane and mixtures of such autorefrigerative hydrocarbons with the aforementioned ketones, propane/MEK, propane/-MIBK, etc.

In an embodiment of the process of this invention a solution of dewaxing aid comprising components (a) and (b) are dissolved in an appropriate solvent, such as a light heating oil or a light dewaxed mineral oil fraction, is mixed into the wax-containing oil and the mixture heated to a temperature higher than the cloud point of the oil (typically about 50° C. to 120° C.). The mixture is introduced, along with the dewaxing solvent, into a chilling zone and chilled to a temperature necessary to yield the desired pour point for the resulting dewaxed oil. The chilling produces a slurry comprising dewaxed oil and solvent, along with solid particles of wax which contain the dewaxing aid. This slurry is then sent to a filter to separate the dewaxed oil and solvent from the wax particles. The dewaxing temperature to which the slurry is chilled varies depending on the feed and conditions. In general, this temperature will range from about 0° C. to about −50° C. In the case where the dewaxing solvent comprises a mixture of a ketone and an aromatic hydrocarbon, such as methyl ethyl ketone/toluene, the dewaxing temperature will range from about −10° C. to about −30° C.

Preferred dewaxing solvents used in the process of this invention include mixtures of ketones, such as MEK/MIBK, mixtures of a ketone and an aromatic hydrocarbon, as well as mixtures of a ketone and methylene chloride. The ratio of solvent to waxy oil would generally range from about 0.5 to 10 and preferably from about 2 to 7, by volume. The optimum amount of dewaxing solvent employed is, of course, determined by the wax content of the oil, viscosity, pretreatment and dewaxing conditions.

Typical oils, therefore, include distillates, preferably medium to heavy distillates, in the 400 neutral to 1,000 neutral range and Bright stocks. These waxy distillates may come from any natural or synthetic sources, such as from tar sands, shale oil, coal liquids, etc.

Preparation of $C_{24}$ (Lignoceryl) Methyacrylate

Into a 250 ml, four-necked flask fitted with a mechanical stirrer, nitrogen inlet, thermometer port, syringe septum, and a Dean-Stark trap equipped with a reflux condenser, was charged 17.2 g. of methacrylic acid, 70.8 g. of lignoceryl ($C_{24}$) alcohol, and 0.1 g. of phenothiazine. While stirring, the mixture was heated to reflux under a blanket of nitrogen. By means of a syringe, 0.5 g. of tetraisopropyl titanate was added dropwise. Heating was continued until the evolution of water ceased. The infrared spectrum of the product confirmed the conversion of acid to ester.

Preparation of Poly (Lignoceryl Methacrylate)

Into a 250 ml, four-necked flask fitted with a mechanical stirrer, nitrogen inlet, thermometer port, and a reflux condenser, was charged 50.0 g. of the above product and 100.0 g. of cyclohexane. With stirring, the mixture was heated to reflux under a blanket of nitrogen. 0.3 g. of Lucidol 70 ® was added. After three hours, the mixture had become very viscous and 0.1 g. of p-methoxy phenol was added. The reaction mixture was then poured into 500 ml of methanol and the polymer, poly (lignoceryl methacrylate) was isolated by vacuum filtration.

EXAMPLES

Four different dewaxing aids were evaluated in varying combinations in two different chilling process sequences. In one sequence (Process I) an incremental dilution procedure was employed utilizing a scraped surface chiller wherein the scraper revolved at 24 rpm, while in the other sequence (Process II) a total predilution procedure was employed using agitated chilling at 200 rpm in an indirect heat exchanger (no scraping). The procedure of Process II is the subject of a separation application, U.S. Ser. No. 867,141, filed May 27, 1986 in the name of Theodore H. West. In Process II a 5.5 inch internal diameter scraped surface chiller is modified so that the scraper blades no longer touch the internal walls of the chilling unit. In the procedure used in this particular experiment the blades are one-half inch away from the chiller walls and are rotating at the aforementioned 200 rpm. Conditions for Process I and Process II are reported in Table A. The oil employed is described in Table I, while the aids employed are listed in Table II, with the results reported in Table III.

TABLE A

RUN CONDITIONS FOR PROCEDURES: PROCESS I AND PROCESS II

1. Incremental Dilution (Process I)

Lab simulation of plant scraped surface chilling using a 5.25" diameter twin-bladed scraper in a 5.25" diameter vessel. Scraper speed is 24 revolutions per minute. Solvent addition is as follows:

| | Dilution V/V | Temperature °C. |
|---|---|---|
| Predilution | .6 | 60 |
| 1st Increment | .47 | 35 |
| 2nd Increment | .57 | 5 |
| 3rd Increment | .57 | −10 |
| Total Dilution | 2.21 Solvent/Feed | −10 |

2. Predilution (Process II)

Lab simulator using a 4.25" diameter twin-bladed paddle in a 5.25" vessel. Paddle speed is 200 revolutions per minute.
Total predilution: 2.2 V/V at 50° C.

Common Conditions to Both Processes:

Solvent - 40/60 V/V MEK/MIBK
Filter Temperature - −10° C.
Chilling Range - 3° C./Minute Performance evaluations by standard filter leaf.

TABLE I

FEED CHARACTERISTICS

| | |
|---|---|
| Feed: | Strathcona MCT 30 (600N?) |
| | Typical Properties |
| | Feed Cloud - 51° C. |
| | Dis. Range - 393–582° C. |
| | Viscosity @ 100° C. - 9.56 cst |
| | R.I. @ 75° C. - 1.4596 |
| | API Gravity - 28.8 |

TABLE II

DEWAXING AID COMPONENTS IN LABORATORY PROCESS SIMULATIONS ON STRATHCONA 600N OIL

| Component Identification | Description | Molecular Weight* Number Average | Polymer Melting Point °C. by DSC |
|---|---|---|---|
| (a) | Dialkylfumarate/vinyl acetate copolymer made from 70% $C_{22}$, 15% $C_{20}$ and 15% $C_{18}$ alcohols. | 8,600 | 49 |
| (b) | Rohm and Haas Acryloid 144, a polyalkylmethacrylate polymer made from 4% $<C_{12}$, 7% $C_{14}$, 39% $C_{16}$, 45% $C_{18}$, 5% $>C_{20}$ alcohols (average 16.5). | 23,000 | 29 |
| (c) | Rohm and Haas Acryloid 150, | 45,000 | −4 |

TABLE II-continued

DEWAXING AID COMPONENTS IN LABORATORY PROCESS SIMULATIONS ON STRATHCONA 600N OIL

| Component Identification | Description | Molecular Weight* Number Average | Polymer Melting Point °C. by DSC |
|---|---|---|---|
| | a polyalkylmethacrylate polymer made from 2% $<C_{10}$, 30% $C_{12}$, 27% $C_{14}$, 14% $C_{16}$, 16% $C_{18}$ and 11% $>C_{20}$ alcohols (average 12.5). | | |
| (d) | Experimental polyalkylmethacrylate polymer made from a single carbon number normal $C_{24}$ alcohol. | 88,000 | 65 |

*Determined by gel permeation chromatography, equivalent polystyrene molecular weight.

TABLE III

DEWAXING PERFORMANCE FOR 600N OIL

| Process | Dewaxing Aid Components | Dewaxing Aid v/v Ratio | Dewaxing Aid Wt. % Active Ingredient On Feed | Melting Point of Dewaxing Aid Mixture | Feed Filter Rate $m^3/m^2d$ | Wax Cake Liquids/ Solids | DWO Yield Wt. % | No Wash | Relative Feed Filter Rate |
|---|---|---|---|---|---|---|---|---|---|
| I | — | Base Case | — | | 5.8 | 7.9 | 52.1 | 38.4 | 1.0 |
| I | a/b | 1/3 | 0.7 | | 10.8 | 3.4 | 78.1 | | 1.86 |
| I | d/b | 1/3 | 0.7 | | 12.6 | 3.2 | 78.1 | 59.2 | 2.17 |
| II | — | Base Case | — | | 10.0 | 6.6 | 58 | 40. | 1.0 |
| II | a/b | 1/3 | 0.5 | 49 to 29 | 10.7 | 1.3 | 78.1 | 70.4 | 1.07 |
| II | d/b | 1/3 | 0.5 | 65 to 29 | 20.6 | 1.6 | 77.4 | 68.9 | 2.06 |
| II | d/b/c | 1/4/5 | 0.18 | | 18.6 | 2.7 | 78.7 | | 1.86 |
| II | d/b/c | 1/4/5 | 0.45 | 65 to 4 | 32 | 1.7 | 78.8 | | 3.2 |
| II | a/b/c | 1/4/5 | .47 | 49 to −4 | 14.8 | 2.3 | 78.8 | | 1.5 |
| II | d | | .1 | 65 | 14.5 | 3.4 | 76.9 | | 1.45 |

From this it is seen that the combination of poly $C_{24}$ alkyl methacrylate with Acryloid 144/150 is significantly superior in performance as a dewaxing aid as compared to the combination of dialkylfumarate/vinyl acetate copolymer with Acryloid 144 or dialkylfumarate/vinyl acetate with Acryloid 144/150. The high melting point experimental $C_{24}$ methacrylate (component D) extends the solubility range of the dewaxing aid mixture toward the first paraffin crystallizing out of solution (the high melting point waxes) and increases the temperature range within which crystal modification of the dewaxing aid is exerted on the wax/solvent/dewaxing aid mixture.

What is claimed is:

1. In solvent dewaxing process wherein a waxy hydrocarbon oil is contacted with a dewaxing solvent and a dewaxing aid and chilled so as to precipitate at least a portion of the wax present in said waxy hydrocarbon oil and the preciptated wax is removed by means of liquid/solid separation means yielding a dewaxed oil, the improvement consisting of using as the dewaxing aid a combination of (A) poly(n-$C_{24}$) alkylmethacrylate polymer and (B) a lower melting point poly ($C_8$–$C_{20}$) alkyl(meth)acrylate polymer.

2. The process of claim 1 wherein the dewaxing aid comprising components (A) and (B) are used in a ratio of A/B in the range of 10/90 to 90/10.

3. The process of claim 2 wherein component (A) has a number average molecular weight ranging from about 50,000 to about 500,000 and a melting point of between about 50° C. to 80° C. and component (B) has a number average molecular weight ranging from about 5,000 to 200,000 and has a melting point of about −30° C. to 50° C.

4. The process of claim 3 wherein the dewaxing aid comprising components (A) and (B) is used at a dose level based on active ingredients of about 0.01 to 2 weight percent.

* * * * *